US010487511B2

(12) United States Patent
Lallier

(10) Patent No.: US 10,487,511 B2
(45) Date of Patent: Nov. 26, 2019

(54) STANDING SEAM ROOF PANEL ANCHOR

(71) Applicant: Mario Lallier, Winsted, CT (US)

(72) Inventor: Mario Lallier, Winsted, CT (US)

(73) Assignee: Mario Lallier, Winsted, CT (US)

( * ) Notice: Subject to any disclaimer, the term of this patent is extended or adjusted under 35 U.S.C. 154(b) by 88 days.

(21) Appl. No.: 15/885,019

(22) Filed: Jan. 31, 2018

(65) Prior Publication Data

US 2019/0234076 A1 Aug. 1, 2019

(51) Int. Cl.

| | |
|---|---|
| ***E04D 13/12*** | (2006.01) |
| ***E04G 5/04*** | (2006.01) |
| ***E04G 21/32*** | (2006.01) |
| ***E04D 15/00*** | (2006.01) |

(52) U.S. Cl.

CPC ..... *E04D 13/12* (2013.01); *E04D 15/00* (2013.01); *E04G 5/041* (2013.01); *E04G 21/328* (2013.01)

(58) Field of Classification Search

CPC ..... E04D 13/12; E04D 15/00; E04G 5/041; E04G 21/328

See application file for complete search history.

(56) References Cited

U.S. PATENT DOCUMENTS

| | | | | | |
|---|---|---|---|---|---|
| 4,606,430 | A * | 8/1986 | Roby | A62B 35/04 | 182/3 |
| 4,799,639 | A * | 1/1989 | Riley | F16B 2/10 | 24/522 |
| 5,460,461 | A * | 10/1995 | McGrath | B05C 17/10 | 269/45 |
| 6,009,973 | A * | 1/2000 | Woodyard | A62B 35/0081 | 182/36 |
| 8,979,051 | B2 * | 3/2015 | Keller | F16B 2/10 | 248/230.5 |
| 9,187,914 | B2 * | 11/2015 | Lallier | E04G 3/265 | |
| 2001/0025464 | A1 * | 10/2001 | Poldmaa | A62B 35/0068 | 52/633 |
| 2011/0314763 | A1 * | 12/2011 | Gandellini | A62B 35/0056 | 52/698 |

* cited by examiner

*Primary Examiner* — Anita M King
(74) *Attorney, Agent, or Firm* — MKG, LLC

(57) ABSTRACT

A roofing anchor configured to be removably secured to a seam of a roofing panel includes a first segment having a first flange configured to contact a first side of the seam upon closing the roofing anchor, and a second segment opposing the first segment, the second segment having a second flange opposite the first flange, the second flange configured to contact a second side of the seam upon closing the roofing anchor. The roofing anchor also includes a hinge mechanism configured to open the roofing anchor to separate the first flange and the second flange by a distance greater than at least a top of the seam, and to close the roofing anchor to bring the first flange and the second flange in contact with the seam. The roofing anchor further includes a securing mechanism configured to apply a compressive force on the seam.

23 Claims, 11 Drawing Sheets

STANDING SEAM ROOF PANEL ANCHOR

TECHNICAL FIELD

The present invention is generally directed toward devices for anchoring or securing people and/or objects to a roof, and more particularly to anchors, brackets or other devices that can be removably fixed to a standing seam of a roof panel.

BACKGROUND

Roofing brackets and anchors designed for positioning a platform and supporting a worker thereon are routinely utilized in the roofing industry. Typically, when a roof is inclined, it can be difficult for a worker to safely perform work while standing or maneuvering on the inclined plane of the roof. Regardless of the incline of a roof, workers and objects (e.g., tools, roofing materials, etc.) should be secured to the roof.

As is known in the art, roofing brackets are secured to a roof and a platform is positioned and retained in place. A plurality of roofing brackets provides a means for establishing a generally horizontal configuration onto which a plank is removably attached such that a generally horizontal plane is provided and a worker may be supported in that generally horizontal position. After a particular section of roofing has been installed, the roofing brackets are removed and repositioned to enable the worker to safely reach another section of the roof.

One significant problem with conventional roofing brackets and anchors, particularly when installing standing seam roof panels, for example a metal roof, is that roofing brackets can cause damage to roofing panels. For example, roofing brackets are typically fastened to roofing panels using set screws or nails compressed against the roof structure (e.g., against standing seams). The use of fasteners such as screws or nails to temporarily fasten a roofing bracket to the underlying roof structure, such as a metal roof panel seam, is detrimental to the roof structure. For example, if a fastener such as a set screw or nail is compressed against or otherwise contacts the surface of a standing seam, the fastener can remove the paint and/or galvanization layer on the seam at the area of contact, which can result in a roof that is less aesthetically pleasing and more prone to rust and corrosion.

SUMMARY

One embodiment of the present invention is directed to a roofing anchor configured to be removably secured to a seam of a roofing panel. The roofing anchor includes a first segment having a first flange configured to contact a first side of the seam upon closing the roofing anchor, and a second segment opposing the first segment, the second segment having a second flange opposite the first flange, the second flange configured to contact a second side of the seam upon closing the roofing anchor. The roofing anchor also includes a hinge mechanism formed by respective features on the first segment and the second segment, the hinge mechanism configured to open the roofing anchor to separate the first flange and the second flange by a distance greater than at least a top of the seam, the hinge mechanism configured to close the roofing anchor to bring the first flange and the second flange in contact with the seam. The roofing anchor further includes a securing mechanism configured to apply a compressive force on the seam via the first flange and the second flange.

Another embodiment of the present invention is directed to a method of removably securing an object or person to a roof by a roofing anchor, which includes opening the roofing anchor, the roofing anchor including a first segment having a first flange, a second segment opposing the first segment, the second segment having a second flange opposite the first flange, and a hinge mechanism formed by respective features on the first segment and the second segment, where opening the roofing anchor includes separating the first flange and the second flange by a distance greater than at least a top of a seam of a roofing panel on the roof. The method also includes disposing the roofing anchor over the seam, closing the roofing anchor via the hinge mechanism to bring the first flange into contact with a first side of the seam and to bring the second flange into contact with a second side of the seam, and securing the roofing anchor to the seam by engaging a securing mechanism to apply a compressive force on the seam via the first flange and the second flange.

A further embodiment of the present invention is directed to an anchoring system for a standing seam roof, which includes a first roofing anchor configured to be removably secured to a first seam of at least one roofing panel, the first roofing anchor including a first pair of opposing segments, the first roofing anchor secured to the first seam by closing the first roofing anchor to bring the first pair of opposing segments in contact with the first seam and maintaining a compressive force on the first seam via the first pair of opposing segments. The anchoring system also includes a second roofing anchor configured to be removably secured to the first seam or to a second seam of the at least one roofing panel, the second roofing anchor including a second pair of opposing segments, the second roofing anchor secured to the second seam by closing the second roofing anchor to bring the second pair of opposing segments in contact with the second seam and maintaining a compressive force on the second seam via the second pair of opposing segments. The anchoring system further includes an attachment configured to be attached to the first roofing anchor and the second roofing anchor, the attachment including an elongated body having a first end and a second end, a first bracket configured to be connected to the first end to attach the elongated body to the first roofing anchor, the first bracket having a first pivot structure configured to permit rotation of the elongated body about a first pivot point proximate to the first end, and a second bracket configured to be connected to the second end to attach the elongated body to the second roofing anchor, the second bracket having a second pivot structure configured to permit rotation of the elongated body about a second pivot point proximate to the second end.

DETAILED DESCRIPTION OF THE DRAWINGS

Figure 1:
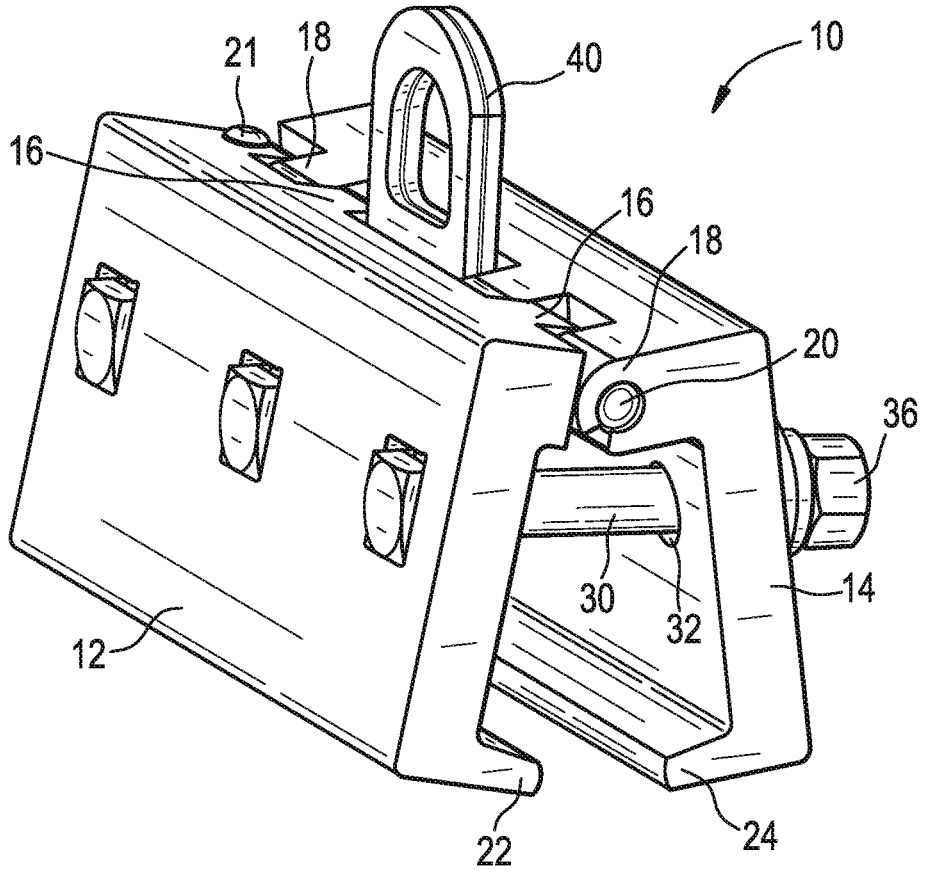
FIG. 1 is a perspective view of an embodiment of a roofing anchor according to the present invention, in an open position.

Devices, systems and methods for anchoring or securing people and/or objects to a roof are provided. An embodiment of a roof securing device and/or system includes at least one anchoring assembly, which includes opposing segments connected by a hinge mechanism. The anchoring assembly is configured to be opened via the hinge mechanism to allow the anchoring assembly to be disposed on a raised seam or other feature of a roof (e.g., a metal roof), and tightened or closed to clamp the opposing segments. The opposing segments and the hinge mechanism allow the anchoring assembly to be fixedly secured to a roof seam without requiring set screws or other mechanisms that could potentially damage the roof seam.

In one embodiment, the opposing segments each include an upper portion that forms part of the hinge mechanism and a lower portion that forms opposing flanges, ridges or inwardly extending protrusions that engage a raised roof seam. In one embodiment, the opposing segments have an identical shape or have at least enough similarity to allow both segments to be formed by a single extrusion.

In one embodiment, the anchoring assembly can be opened and closed as a single unit, i.e., without having to remove any parts. For example, the segments each include one or more holes through which one or more bolts can be inserted. Nuts on the bolts can be partially loosened or unscrewed to allow a gap between the flanges to be widened in order to dispose the anchoring assembly on the roof seam, and can subsequently be tightened or screwed to narrow the gap between the flanges and hold the anchoring assembly in place by a compressive force on the roof seam. Each bolt has a length sufficient to allow the flanges to be separated by a selected distance (e.g., corresponding to a width at the top of the roof seam) without having to remove the bolt.

The anchoring assembly has features including the hinge mechanism that allow the anchoring assembly to be compatible with a wide variety of roof panel and/or seam types and sizes. For example, the hinge mechanism allows the opposing segments to be separated by a variety of distances to accommodate different seam widths. In addition, in one embodiment, the opposing segments define a cavity having a selected width so that the anchoring assembly can be fit over relatively wide parts of a seam. The hinge and the opposing segments are designed so that the anchoring assembly can be opened and installed onto a seam without having to remove bolts or other parts of the assembly, thereby allowing installation without resulting in any loose parts.

The anchoring assembly can be utilized as a safety tool and/or as part of a safety system that can be easily installed on a roof and effectively used as part of a safety feature or safety system for a roof. For example, the anchoring assembly can be connected to a cable or rope and connected to a worker so that, if the worker falls off the roof he or she does not hit the ground. In another example, a guardrail system can be used in conjunction with the use of a safety rope or in place of the safety rope. FIGS. 1-6 show an embodiment of an anchoring assembly 10 (also referred to herein as an anchor 10) for anchoring, securing and/or supporting persons and/or objects on a roof. In one embodiment, the anchoring assembly 10 is configured to engage a raised or standing seam (or other raised feature) on a metal roof. The term "roof seam" or "raised roof seam" describes one type of feature of a metal roof or other type of roof; it is to be understood that descriptions of a roof seam or raised roof seam are not intended to limit the invention to any particular type of roof feature.

The anchor 10 includes a first anchor segment 12 and a second anchor segment 14, which are operably connected via a hinge mechanism. In one embodiment, the hinge mechanism includes one or more cylindrical or semi-cylindrical features 16 at an upper portion of the first segment 12, and one or more cylindrical or semi-cylindrical features 18 at an upper portion of the second segment 14. The cylindrical or semi-cylindrical features 16 and 18 each have internal bores having a size selected to receive a cylindrical rod 20. The rod 20 acts as a pivot and defines a rotational axis (the hinge axis), about which the segments rotate to open the anchor 10. A set screw 21 or other fixing mechanism may be employed to hold the rod 20 in place. In one embodiment, the rod includes a notch into which the set screw 21 is inserted to prevent the rod 20 sliding out of the bores.

Figure 7:
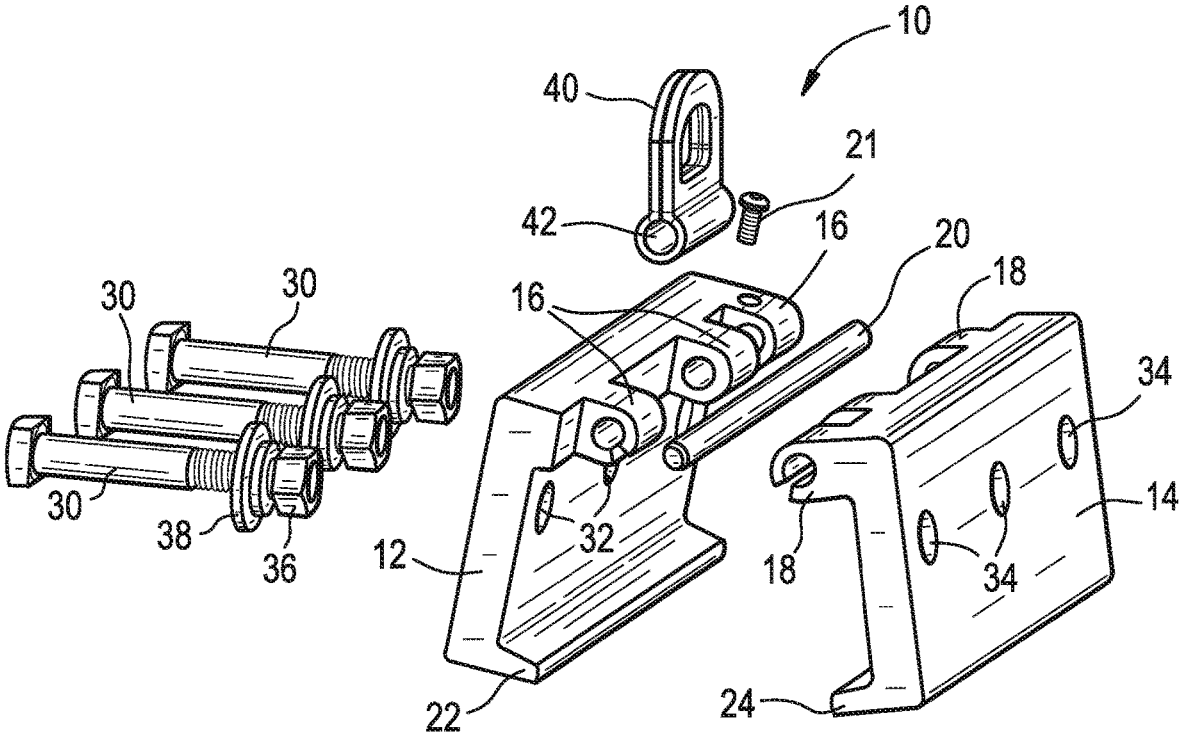
FIG. 7 is a perspective view of an embodiment of a disassembled roofing anchor according to the present invention.
Figure 8:
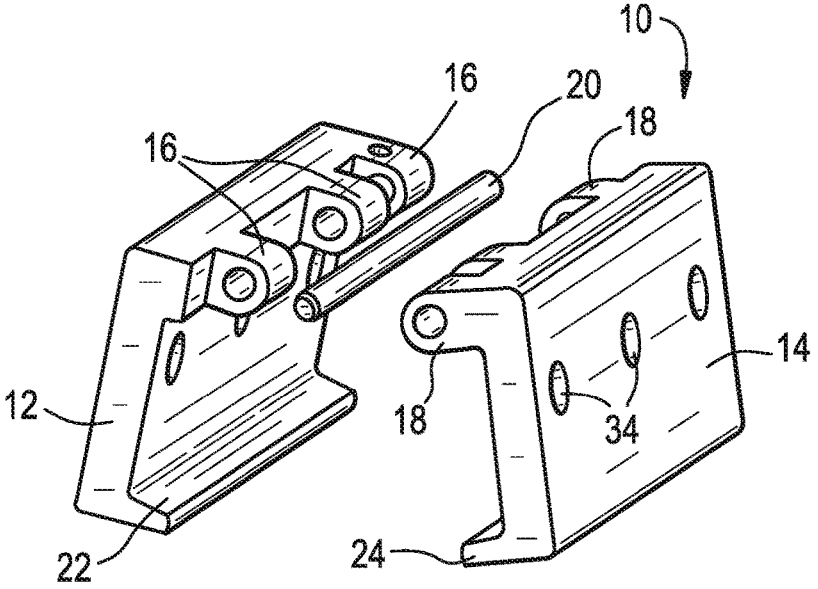
FIG. 8 is a perspective view of an embodiment of a disassembled roofing anchor according to the present invention.

FIGS. 7 and 8 show alternative embodiments of the cylindrical features. In one embodiment, shown in FIG. 7, the features 16 and 18 are partially cylindrical, i.e., a gap is formed in the cylindrical wall of each feature 16 and 18. In another embodiment, shown in FIG. 8, the features 16 and 18 are fully cylindrical, i.e., there are no gaps in the cylindrical wall.

The segments 12 and 14 also define respective lower portions that are configured to engage a roof seam to clamp the anchor 10 in a fixed position relative to the seam. The lower portions define respective flanges, ridges or other protrusions that extend inwardly, i.e., at least partially perpendicular to the hinge axis and toward one another. For example, the first segment 12 includes a first inwardly extending flange 22 and the second segment 14 includes a second inwardly extending flange 24.

Figure 2A:
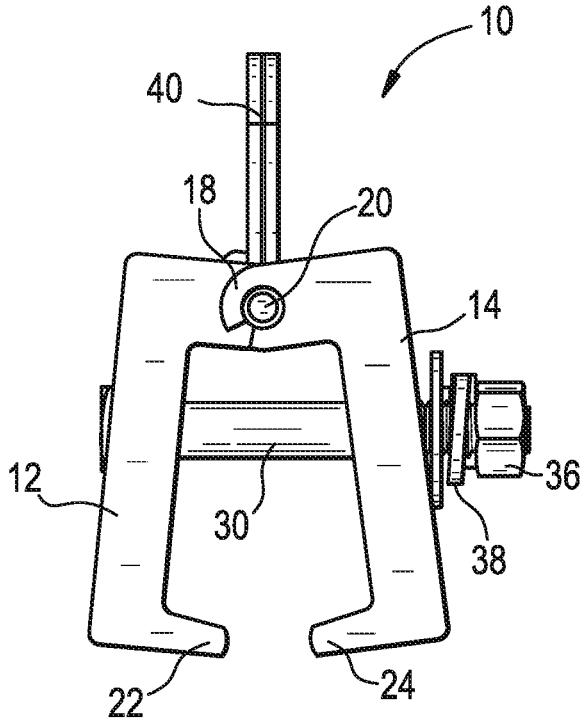
FIG. 2A is a side view of the roofing anchor of FIG. 1 in the open position.
Figure 2B:
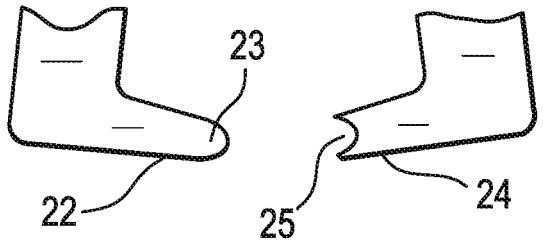
FIG. 2B is a close-up view of an example of flanges forming part of the roofing anchor of FIG. 2A.
Figure 5:
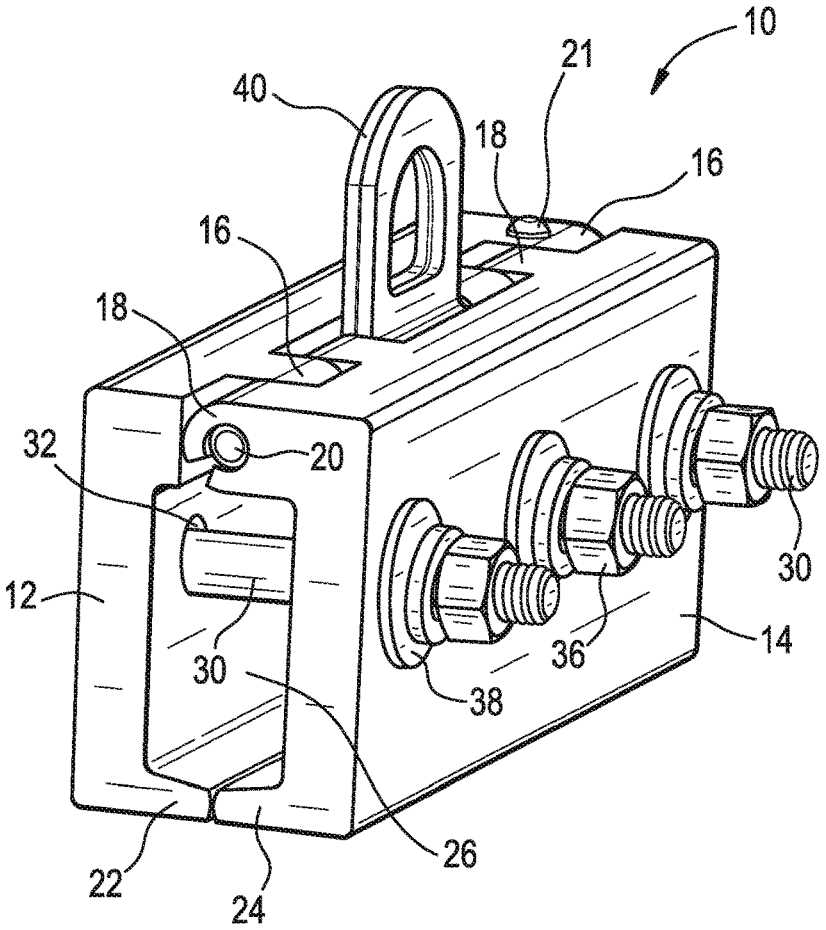
FIG. 5 is a perspective view of the roofing anchor of FIG. 1, in a closed position.
Figure 6:
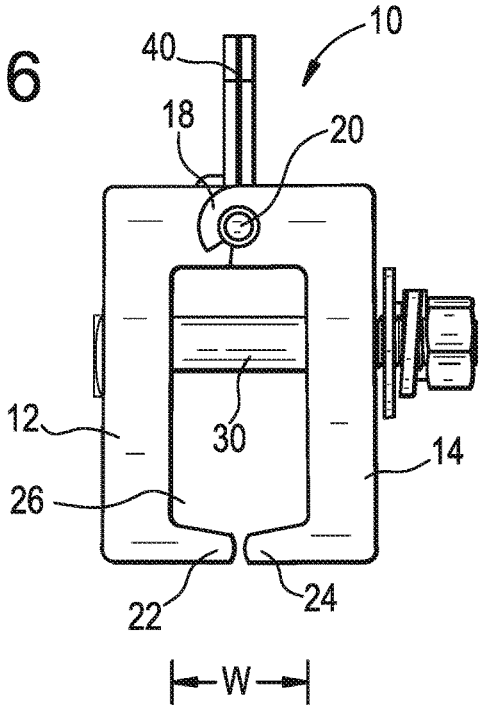
FIG. 6 is a side view of the roofing anchor of FIG. 1 in the closed position.

In an open position, as shown in FIGS. 1, 2A and 2B, the segments are rotated about the rod 20 so that the flanges 22 and 24 are separated by a distance that is at least the width of the top of a roof seam, so that the segments 12 and 14 can be installed over the top of the seam. In a closed position, as shown in FIGS. 5 and 6, the flanges 22 and 24 are pushed together or in contact with respective sides of the roof seam, and thereby define a cavity 26. The cavity 26 has a width "W" that is selected to be greater than the top of the seam. In this way, the segments 12 and 14 can be disposed so that the cavity 26 surrounds a length of the top of the seam and the flanges 22 and 24 are below the top of the seam and can be brought together to clamp against the seam. The flanges 22 and 24 may terminate at any suitable shape, such as a flat surface, a point, a circle, etc. For example, as shown in FIGS. 1, 2A and 5-8, the flanges terminate so that they have beveled ends to avoid scratching or otherwise damaging the seam when the anchor 10 is secured thereto.

Another example of the flanges 22 and 24 is shown in FIG. 2B. In this example, flange 22 terminates in a rounded or beveled end 23 having a convex shape, i.e., extending away from the flange 22 and toward the flange 24 and a seam (when engaged). Flange 24 terminates in an end having a concave shape, i.e, extending away from the flange 22 and a seam (when engaged). The shape and/or configuration of the ends 23 and 25 is not limited to this example and can have other shapes and configurations, such as the flange 22 having a concave shape end and the flange 24 having a convex shape end, both the flanges 22 and 24 having concave ends or both the flanges 22 and 24 having convex ends.

The segments 12 and 14 may be made from any suitable material, such as aluminum, stainless steel, plastic, etc. In one embodiment, the segments 12 and 14 are each made from a single material, e.g., extruded or otherwise formed (e.g., casted, printed) as a single rigid piece or part.

The anchor 10 also includes a securing mechanism configured to apply a force to clamp the anchor 10 and the flanges 22 and 24 against a roof seam. In one embodiment, the securing mechanism includes one or more elongated members, such as one or more bolts 30, each of which extends through a first hole 32 in the first segment 12 and a second hole 34 in the second segment 14. Although the elongated member is described in embodiments as a bolt, it is not so limited. Reference to a bolt is understood to mean any suitable rod, pin, screw, bolt or other elongated member.

Each bolt 30 is secured to the segments via a nut 36 and washers 38. The bolt 30 also has a threaded section onto which the nut 36 is screwed. Each nut 36 can be screwed to close the anchor 10 and/or apply a compressive force via the flanges 22 and 24 against the sides of the seam. Likewise, each nut 36 can be unscrewed to allow the anchor 10 to be opened. In this way, the distance between the flanges 22 and 24 can be regulated by screwing and unscrewing the nut 36.

In one embodiment, the length of the bolt 30 and the length of the threaded section are selected so that the anchor 10 can be open and closed without having to remove any parts. For example, the nut 36 can be rotated in a first direction to open the anchor and create a separation between the segments 12 and 14 that allows the anchor 10 to be lowered past the top or other relatively wide part of the seam. The nut 36 can then be rotated in an opposite direction to pull the segments 12 and 14 together and hold the anchor 10 in place against the seam via a compressive force generated by screwing the nuts. The actions of opening the anchor 10 and pulling the segments 12 and 14 together can, in this embodiment, be performed without having to remove any bolt 30 and any nut 36.

In one embodiment, the holes 32 and 34 are shaped to accommodate the diameter of each bolt 30 and allow some clearance so that rotation of the segments 12 and 14 can be achieved while each bolt 30 is in place. For example, as shown in FIGS. 7 and 8, the holes 32 and 34 may be oblong to allow the anchor 10 to be opened without resistance.

The holes 32 and 34 may be designed so that the bolts 30 (or other fasteners) are not screwed directly into the body of either opposing segment, and can be inserted through the holes 32 and 34 and held in place by compression via nuts. The holes 32 and 34 thus do not need to be threaded, which reduces manufacturing cost and complexity. In addition, this hole design reduces wear on the opposing segments so that the useful life of the anchor 10 is extended. For example, threading can wear over time, and thus by excluding threading from the holes 32 and 34 there are no threads to wear. In addition, as threads wear on the bolts, only the bolts need be replaced, thereby avoiding having to replace the opposing segments or the entire anchor 10. This is advantageous over, e.g., tools that have internal threading; as threading wears, the entire tool must be replaced. This eventuality is avoided by the design described herein.

Figure 3:
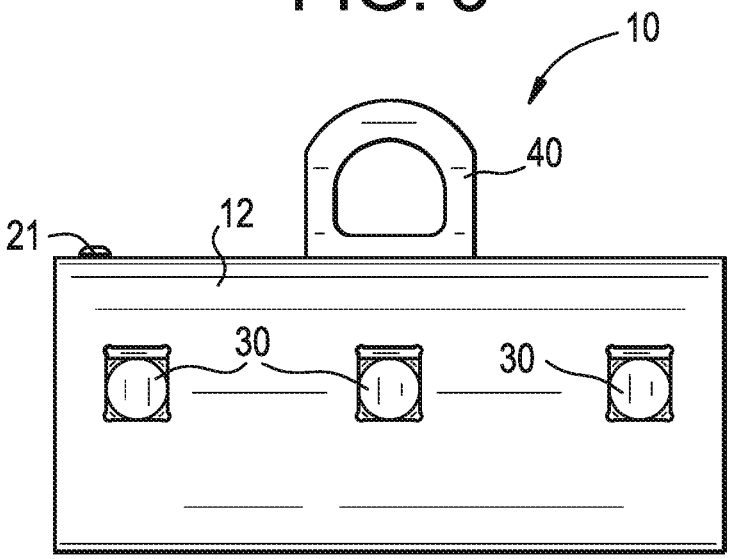
FIG. 3 is a front view of the roofing anchor of FIG. 1.
Figure 4:
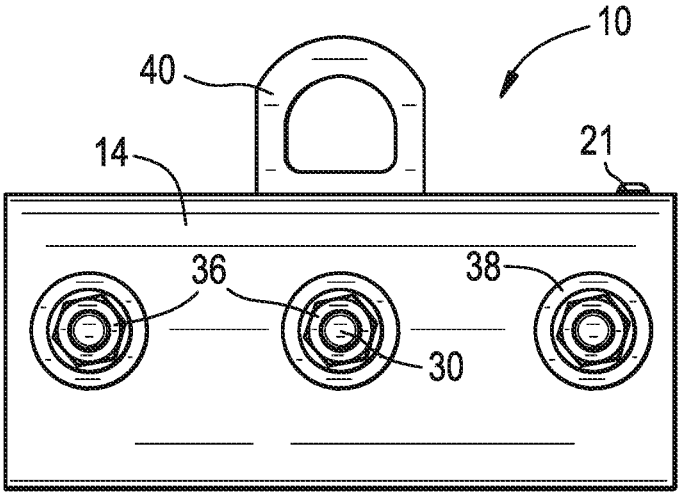
FIG. 4 is a rear view of the roofing anchor of FIG. 1.

The segments 12 and 14 may include other features to facilitate operation of the anchor 10. For example, as shown in FIGS. 1 and 3, each hole 32 of the first segment 12 terminates in a recess shaped to conform to the shape of the bolt head and restrict rotation of the bolt 30. In this example, the recess is rectangular or square, but could be any shape suitable for accommodating a bolt head (e.g., hexagonal). The recess also allows a nut or other mechanism to be tightened to close the anchor 10 with only one wrench, which helps to reduce the number of tools (and hence the number of objects that could fall or need securing).

In the embodiments described herein, the force required to secure the anchor 10 is provided by screwing each of one or more nuts 36 onto a respective bolt 30. However, the anchor 10 is not so limited, and could have a number of additional or alternative features for applying a force to the segments 12 and 14 or otherwise holding the anchor 10 in a fixed position on the seam, such as a spring mechanism.

The anchor 10 may include one or more components for facilitating attachment of persons and/or objects to the anchor 10. For example, as shown in FIGS. 1-7, an anchor point 40 is removably secured to the anchor 10 and provides an attachment point for, e.g., safety leads so that a person working on a roof is prevented from falling. In one embodiment, the anchor point 40 includes a hollow tubular cavity 42 configured to be slid over the rod 20 and held in place between the hinge features 16 and 18. The anchor point 40 may also provide a handle by which the anchor 10 can be carried. A variety of components may be attached to the anchor 10, which may be connected to the anchor 10 via one or more of the bolts 30. Examples of such components include safety lines, platforms, scaffolding, guardrails, tool kits, roofing materials and others.

Figure 9:
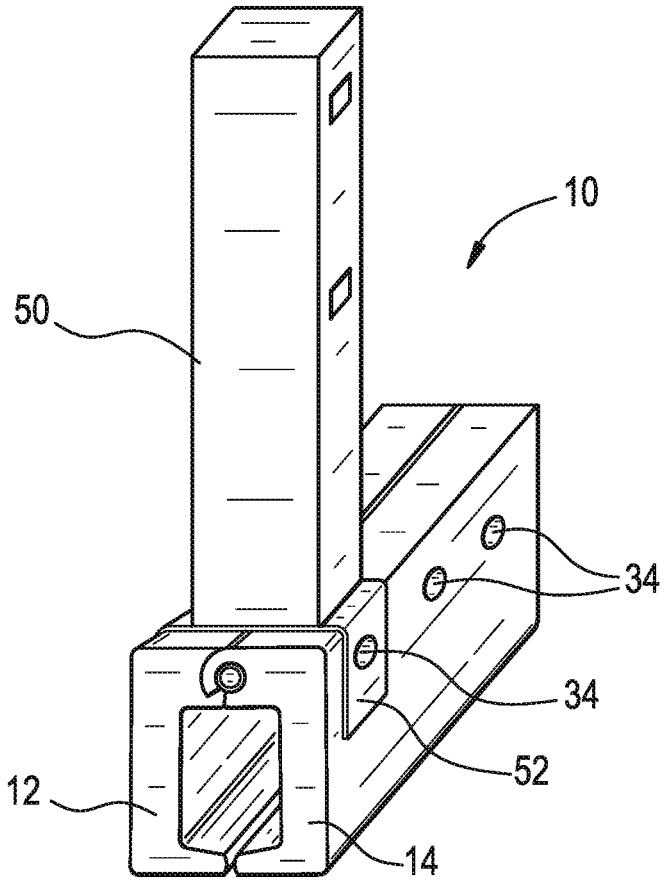
FIG. 9 is a perspective view of the roofing anchor of FIG. 1 having a guardrail post temporarily attached thereto.

Another example of a component that can be removably attached to the anchor 10 is shown in FIG. 9. In this example, the component is a guardrail post 50, which includes a bracket 51 (or multiple brackets) that can be attached to the anchor 10. The guardrail post 50 can be attached to the anchor 10 using one or more of the existing bolts 30. For example, the bracket 51 includes holes that can be fit in line with holes 32 and 34, so that a bolt 30 can be inserted through both the bracket 51 and the segments 12 and 14 and held in place via a nut 36. It is noted that, if there are multiple sets of holes 32 and 34, the guardrail post 50 can be attached or removed without having to remove the compressive force keeping the anchor 10 in place, as one or more of the bolts 30 continue to secure the anchor 10 while the guardrail 50 is attached or removed.

Figure 10:
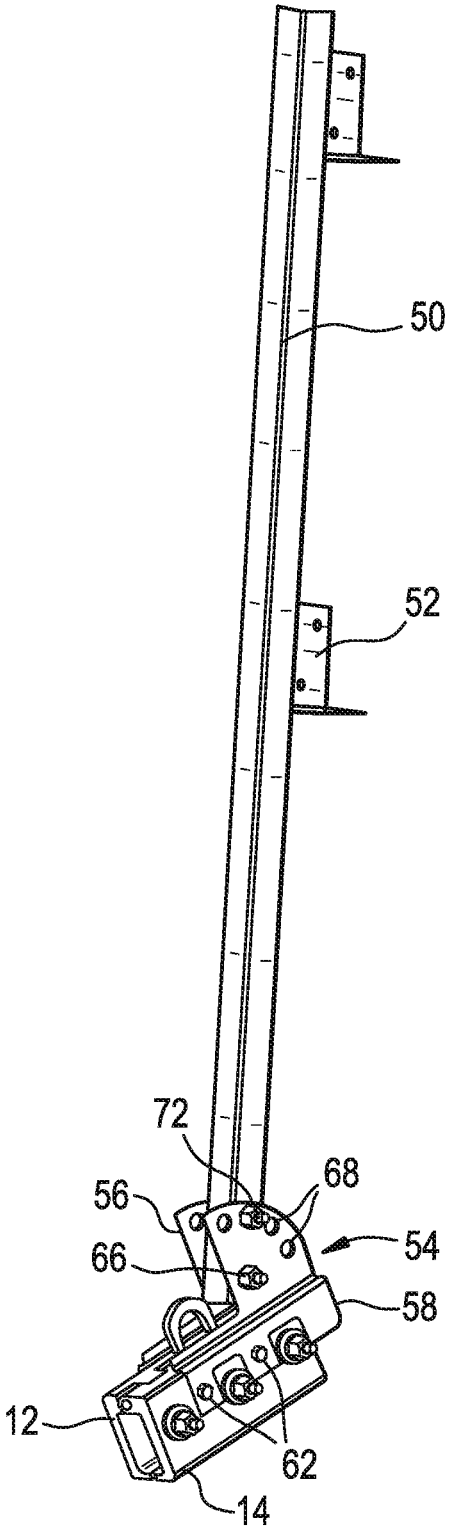
FIG. 10 is a perspective view of an embodiment of a guardrail assembly including a guardrail post rotatably connected to a roofing anchor.
Figure 11:
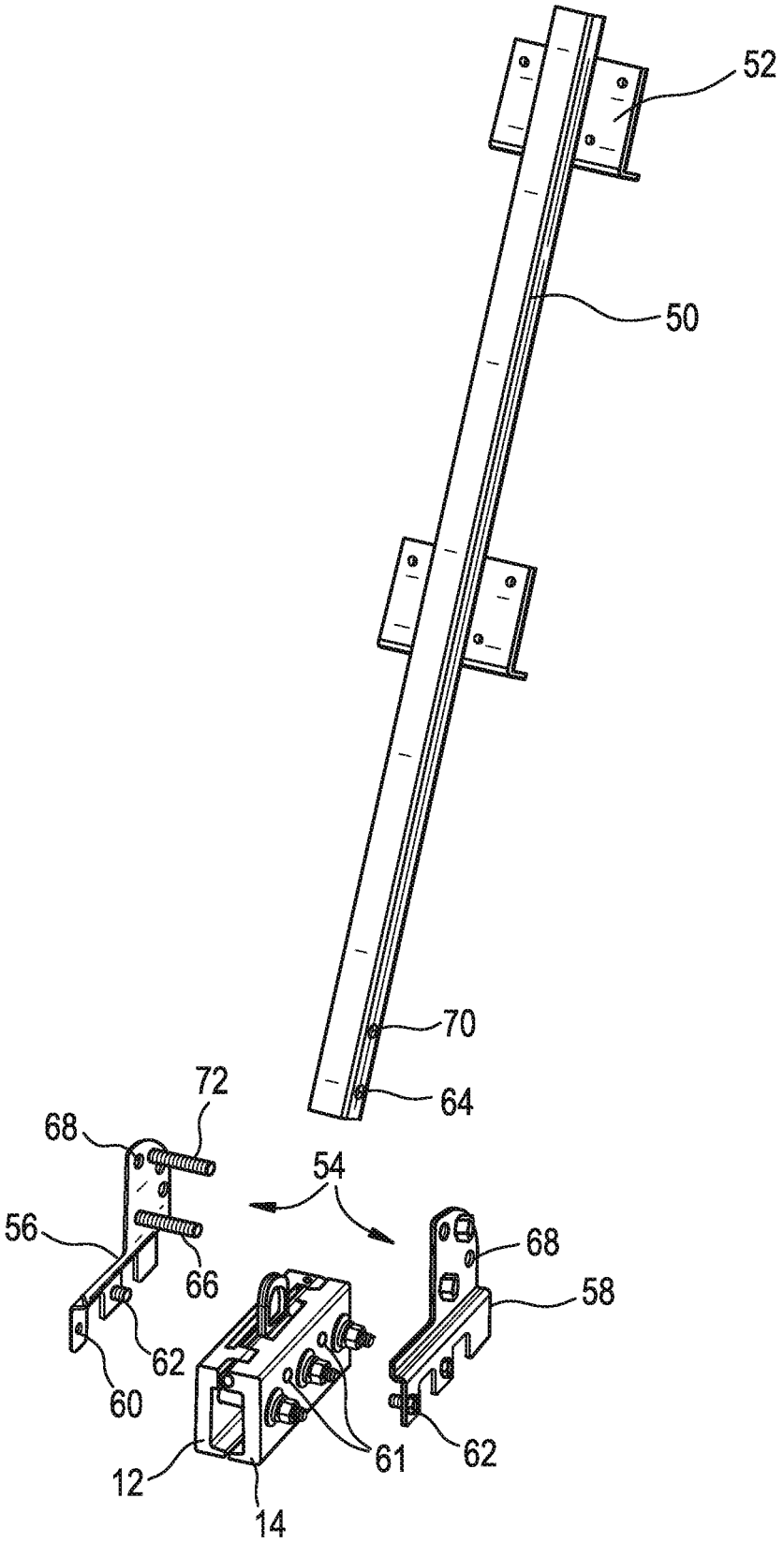
FIG. 11 is a perspective view of the guardrail assembly of FIG. 10 as disassembled.

FIGS. 10 and 11 show another example of the guardrail post 50, which is rotatably connected to the anchor 10. The guardrail post 50 can be rotated between a flat position in which the guardrail post 50 is substantially parallel to a longitudinal axis of the anchor 10, and an upright position in which the guardrail post 50 is substantially perpendicular.

The guardrail 50 can be rotated to various positions between the flat position and the upright position, e.g., to accommodate roofs having different pitches. The guardrail post 50 may include attachment points 52 that allow a crossbar, rope or other component to be attached to the guardrail post 50 to create a guardrail.

The guardrail post 50 is connected to the anchor 10 via a bracket 54 that includes structures that allow the guardrail post 50 to be rotated and may also include structures that can hold the guardrail in one or more selected position. For example, the bracket 54 includes a first bracket component 56 and a second bracket component 58. The bracket components are removably attached to the opposing segments 12 and 14, e.g., the first bracket component 56 is removably attached to the first segment 12 and the second bracket component 58 is removable attached to the second segment 14.

As shown in FIGS. 10 and 11, each of the bracket components 56 and 58 include one or more holes 60 configured to align with corresponding holes 61 in segments 12 and 14. The bracket components 56 and 58 may be attached to the anchor via screws 62 or other fasteners that are screwed through the holes 60 and into the segments 12 and 14.

To allow for rotation of the guardrail post 50, the bracket components 56 and 58 each include a pivot hole opposing each other, and the guardrail post 50 includes a respective hole 64 configured to be aligned with the pivot holes. A pivot pin 66 can be inserted through the pivot holes and the respective hole 64 to establish a pivot point about which the guardrail post 50 rotates. To allow for maintaining the guardrail post 50 at one or more intermediate positions, each bracket component 56 and 58 includes one or more adjustment holes 68, and the guardrail post 50 includes a corresponding hole 70. To maintain the guardrail post 50 at a selected intermediate position, the guardrail post 50 is positioned so that the corresponding hole 70 is aligned with a selected pair of adjustment holes 68, and an adjustment pin 72 is inserted through the adjustment holes 68 and the corresponding hole 70.

It is noted that the bracket 54 is not limited to the examples shown herein and may have any suitable shape or form. For example, the bracket components 56 and 58 may include holes or other features that overlap the holes 32 and 34 (shown in FIGS. 7 and 8), so that one or more bolts 30 can be used to both secure the anchor 10 to a seam and hold the bracket components 56 and 58 in place. In another example, the bracket 54 is made from a single piece instead of components.

Figure 12:
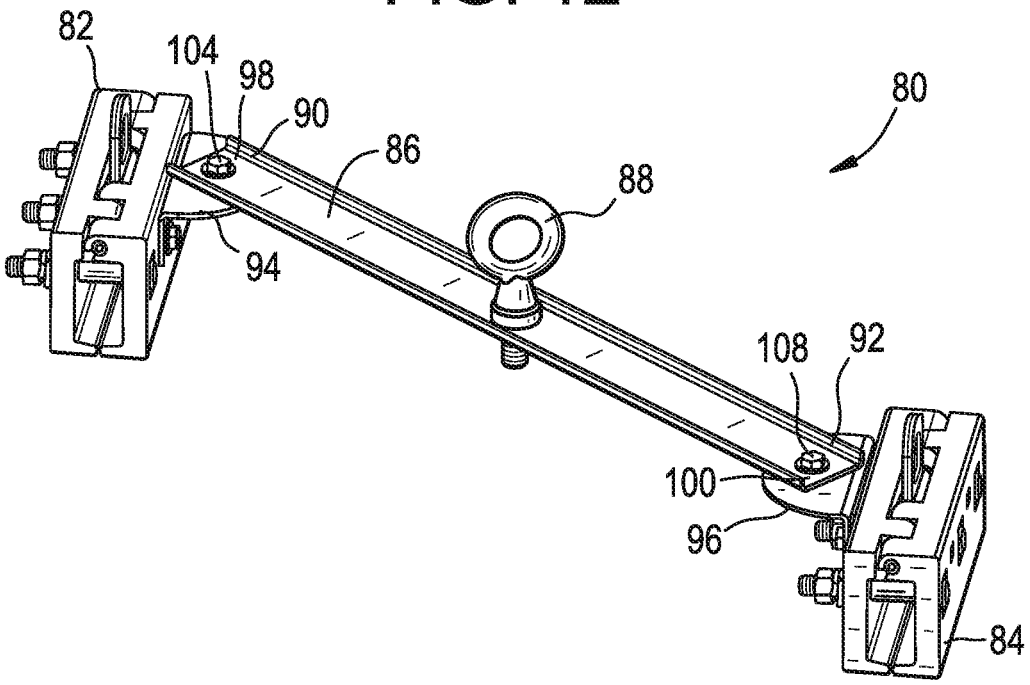
FIG. 12 is a perspective view of an embodiment of an anchoring system including a plurality of roofing anchors.
Figure 13:
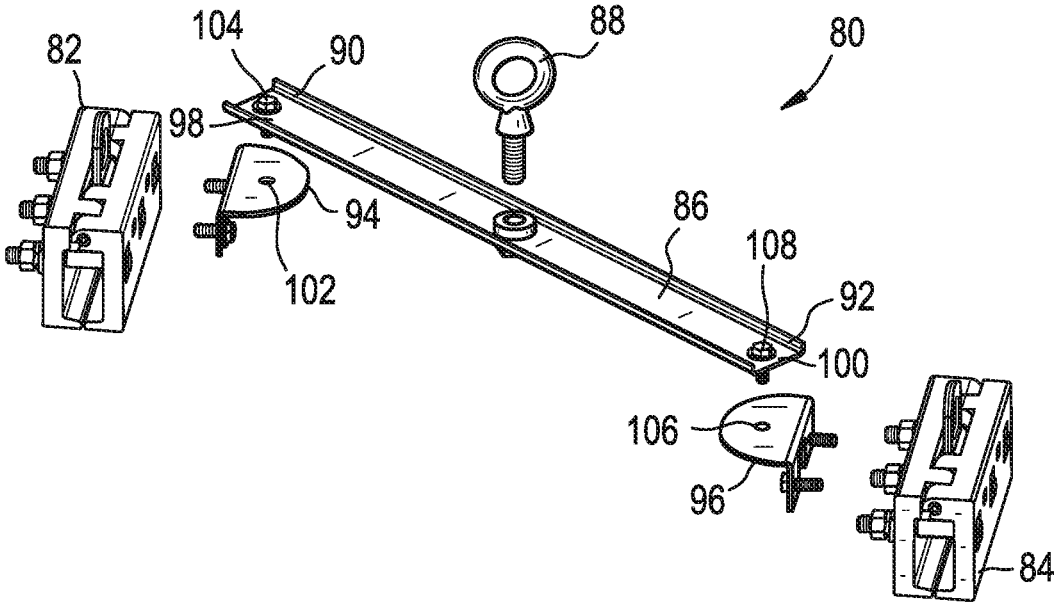
FIG. 13 is a perspective view of the anchoring system of FIG. 12 as disassembled.

FIGS. 12 and 13 show an embodiment of an anchoring system 80 that incorporates the anchor 10. The anchoring system 80 includes at least two anchors 10 that are configured to be secured to respective standing seams. The two anchors 10 shown in FIGS. 12 and 13 include a first anchor 82 and a second anchor 84, which can be secured to adjacent seams or seams being a variety of distances apart.

The anchoring system 80 includes an attachment configured to engage both of the first anchor 82 and the second anchor 84. The attachment, in this embodiment, is a beam, rod or other elongated body 86, which can be made from any suitable material. For example, the elongated body 86 can be a rigid body made from aluminum, steel or other suitable material, or can be a flexible body made from, e.g., plastic. Various components can be attached to the elongated body 86, such as a threaded loop 88 (e.g., an eye bolt). Any type of component can be attached to the elongated body 86, and can be attached to the elongated body at a central location of the elongated body and/or at one or more other locations of the elongated body 86.

The elongated body 86 includes a first end 90 that is rotatably attached to the first anchor 82 and a second end 92 that is rotatably attached to the second anchor 84. For example, the ends 90 and 92 are attached (e.g., via a bolt or screw) to respective attachment brackets 94 and 96, so that each end rotates about a respective pivot point 98 and 100. The pivot point 98 in this embodiment is formed by a hole 102 that extends at least substantially perpendicular to the longitudinal axis of the elongated body 86, a hole through the elongated body 86 at or near the first end 90, and a pin or bolt 104. Similarly, the pivot point 100 is formed by a hole 106 that extends at least substantially perpendicular to the longitudinal axis of the elongated body 86, a hole through the elongated body 86 at or near the second end 92, and a pin or bolt 108. The anchoring system 80 can be secured to standing seams at a variety of locations and having a variety of distances therebetween. For example, the feature of the elongated body 86 being able to pivot proximate to each anchor allows the anchoring system 80 to be adjusted to accommodate a selected distance between seams. In addition, due at least to the system's ability to swivel or pivot, the anchoring system can be adjusted to accommodate different distances without having to modify the anchors themselves.

Figure 14:
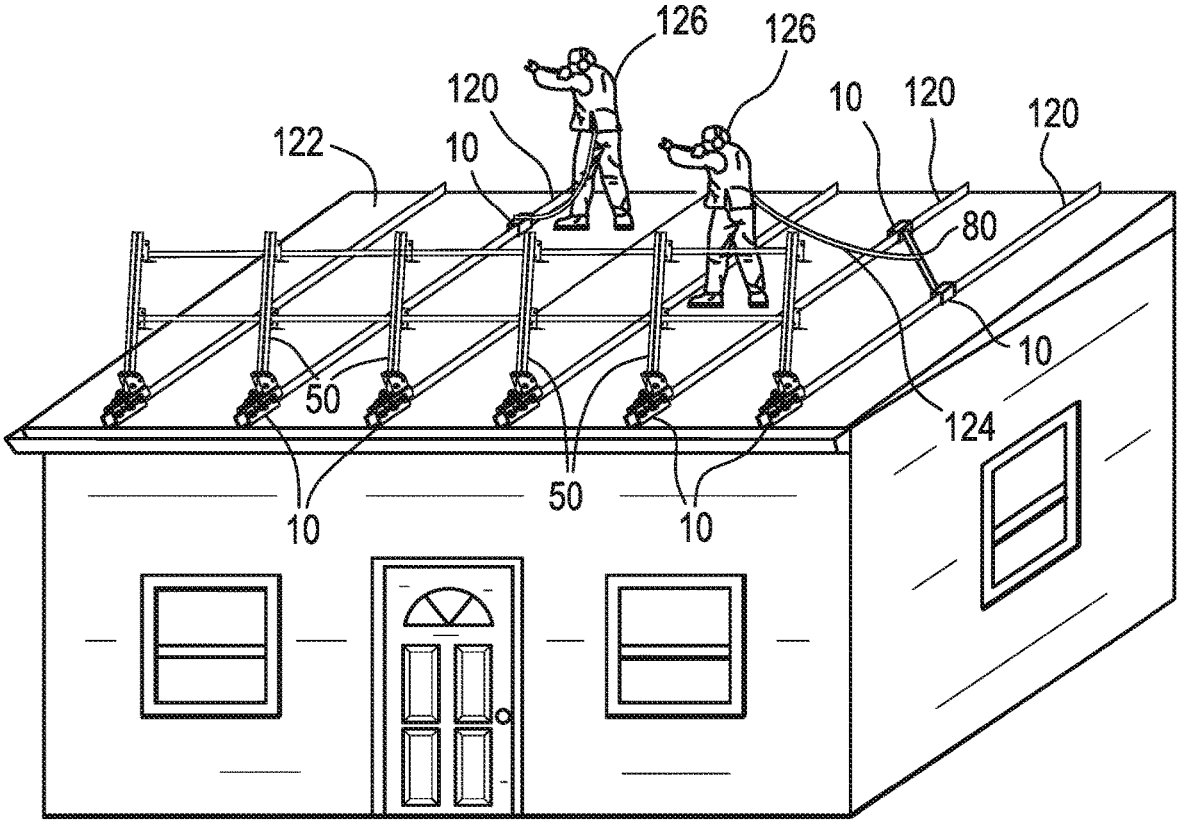
FIG. 14 shows an example of use of the roofing anchor in conjunction with a safety rope and/or a guardrail system on a roof.

FIG. 14 shows an example of a use of the anchor 10 and components that can be used with the anchor 10. In this example, an anchoring system 80 is removably secured to standing seams 120 of an inclined roof 122. The anchoring system 80 includes two anchors 10 secured to adjacent standing seams 120. As is shown, because the distance between the seams 120 is less than the length of the elongated body 86, the anchors 10 are offset so that the elongated body extends between the seams 120 without having to deform or otherwise modify the elongated body 86.

Any of a variety of objects and/or a person can be secured to the roof 122. In this example, a safety lead or rope 124 is attached to the elongated body 86 and also attached to a worker 126 to prevent the worker 126 from falling off of the roof 122. Alternatively or in addition to the anchoring system 80, a worker 126 can be secured to a single anchor 10 via, e.g., a safety lead or rope 124.

The example of FIG. 14 also shows a guardrail formed by a plurality of guardrail posts 50 attached to respective anchors that are arrayed along the roof 122. As noted above, the angle between each guardrail post 50 and its respective anchor 10 may be adjusted to accommodate a variety of roof pitches.

Figure 15:
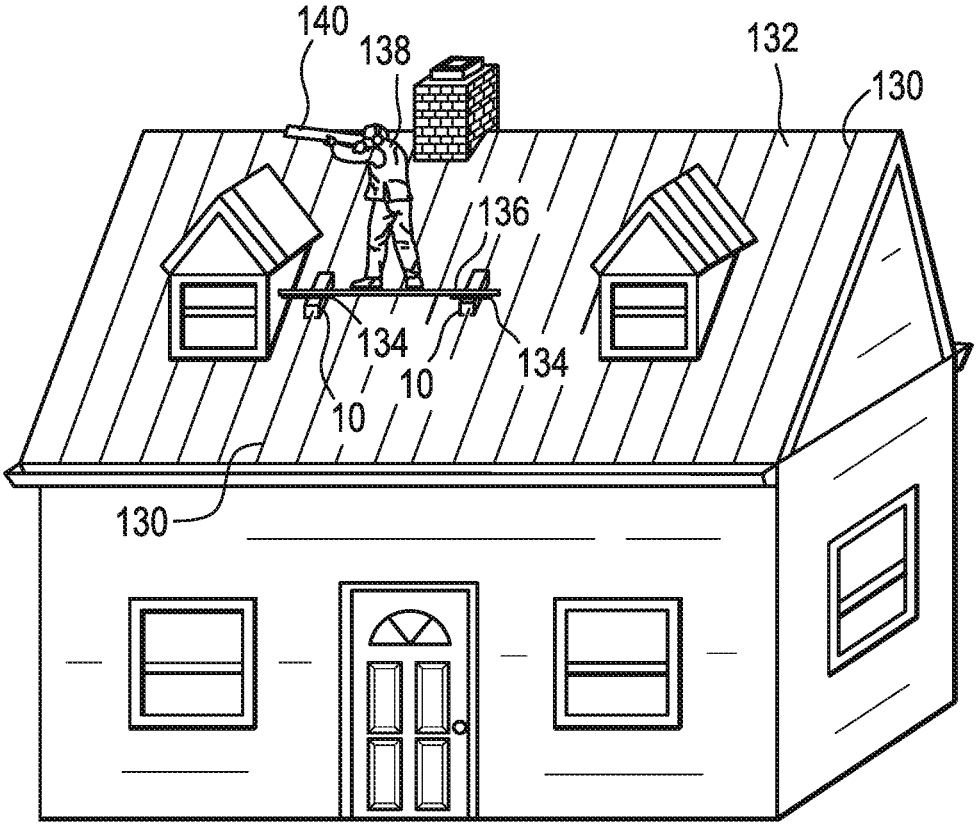
FIG. 15 shows an example of use of the roofing anchor in conjunction with installing a roof and/or performing various tasks on a roof.

FIG. 15 shows another example of a use of the anchor 10 and components that can be used with the anchor 10. In this example, a pair of anchors 10 (or any desired number of anchors 10) are removably secured to standing seams 130 of an inclined roof 132. A support bracket 134 is attached to each anchor 10 (e.g., by securing the bracket using one or more of the bolts 30). The support brackets 134 provide mounting points for a substantially horizontal platform 136 on the inclined roof 132. The platform can be, for example, a wooden plank (e.g., a hardwood 2 inch-×-12 inch, 2 inch-×-8 inch, or 2 inch-×-10 inch plank) of sufficient length to span at least two anchors 10. The platform 136 can be used by a worker 138 to accomplish various tasks while on the roof, e.g., installing roofing panels 140.

It is noted that the anchor 10, the anchoring system 80 and other embodiments may be used on a roof having any pitch, including a flat roof. Workers on flat roofs may desire or need to have an anchoring device or system, e.g., due to applicable regulations.

Although in some embodiments a single anchor 10 is secured to a standing seam, they are not so limited. Multiple anchors 10 can be secured to a single seam, either in a connected or attached manner (i.e., the anchors are connected to each other, proximate to each other and/or in contact with each other) or separately. For example, two or more anchors can be secured to a single seam. In one embodiment, multiple anchors 10 can be secured to a single seam and connected via a suitable attachment or component. For example, the anchors 10 of the anchoring system 80 can be secured to different seams (as shown, e.g., in FIG. 14) or secured to the same seam, with the elongated body 86 being generally parallel with the seam. Securing multiple anchors on a single seam as part of an anchoring system may be helpful, e.g., in situations where securing multiple anchors is needed to withstand high torques (e.g., required by government regulation) because the gage of a seam is too small to withstand the torque with one anchor alone.

A method of removably securing an anchor 10 includes a number of steps described as follows. In one embodiment, the method includes all of the steps in the order described. However, the method may include fewer than all of the steps and/or the steps may be performed in a different order.

The method is described in conjunction with the anchor 10, but is not limited thereto and may be applicable to any suitable anchoring device or mechanism having characteristics of the anchor 10, such as a hinge mechanism, a cavity defined by opposing segments and/or a cavity defined by inwardly extending flanges. The method is also described in conjunction with the roof 122 of FIG. 14 and/or the roof 132 of FIG. 15, but is not so limited and can be used with any type of roof having standing seams or other raised features.

In a first step, the anchor 10 is assembled. The segments 12 and 14 are brought together so that the features 16 and 18 line up along the hinge axis. The rod 20 is inserted through the features 16 and 18, and optionally a component such as the anchor point 40 is installed on the rod 20. One or more bolts 30 are then inserted through holes 32 and 34 and one or more nuts 36 are screwed onto threaded lengths of the bolts 30. One or more other components, such as a guardrail post or platform support structure, may be installed on the anchor 10 and held on the anchor 10 by one or more of the bolts 30.

In a second step, the anchor 10 is set to an open position by rotating the segments 12 and 14 about the hinge mechanism so that the flanges 22 and 24 are separated by a distance that is greater than the width of the top of a seam, e.g., a standing seam 120 or 130. The nuts 36 are screwed counter clockwise as necessary to permit the flanges to be separated by the selected distance.

In a third step, the anchor 10 is disposed at the seam by lowering the anchor 10 on to the seam so that the flanges 22 and 24 are below the seam and the cavity 26 surrounds a length of the top of the seam. In a fourth step, the segments 12 and 14 are rotated to bring the flanges 22 and 24 into contact with the seam, and the nuts 36 are rotated clockwise to apply a compressive force to the seam and hold the anchor 10 in place. If a component is installed on the anchor 10 via one or more bolts 30, rotating the nuts 36 to secure the anchor 10 also serves to hold the component in place. In a fifth step, a platform, guardrail, safety line or other object or device is connected to the anchor 10.

It is noted that at least the second step through the fourth step may be performed without completely removing any of the bolts 30 or other parts of the anchor 10, thereby allowing a worker to install the anchor 10 without removing any components or having any loose parts.

Embodiments described herein provide a number of advantages and improvements over prior art devices and systems. One significant problem with the roofing brackets known in the art, particularly when installing standing seam roof panels, for example a metal roof, is that the roofing brackets are fastened to the roof seams using nails or other fasteners compressed against the roof structure. The use of fasteners such as nails or screws to temporarily fasten a roofing bracket to the underlying roof structure is detrimental to the standing seam roof panel substrate. The embodiments described herein eliminate the need for such fasteners and thereby reduce or eliminate damage to roof seams.

In addition, the roofing anchor described herein avoids much of the complexity inherent in prior art devices and provides a relatively compact anchor that can be easily transported to a roof top. Further advantages of the embodiments include allowing the roofing anchor to be easily installed, e.g., with one hand, and allowing the anchor to be installed without requiring the removal of bolts or other components.

Although this invention has been shown and described with respect to the detailed embodiments thereof, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A roofing anchor configured to be removably secured to a seam of a roofing panel of a roof, the roofing anchor comprising:

a first segment having a first flange configured to contact a first side of the seam upon closing the roofing anchor;

a second segment opposing the first segment, the second segment having a second flange opposite the first flange, the second flange configured to contact a second side of the seam upon closing the roofing anchor;

a hinge mechanism formed by respective features on the first segment and the second segment, the hinge mechanism configured to open the roofing anchor to separate the first flange and the second flange by a distance greater than at least a top of the seam, the hinge mechanism configured to close the roofing anchor to bring the first flange and the second flange in contact with the seam; and a securing mechanism includes a first hole in the first segment, a second hole in the second segment, and an elongated member configured to be inserted through the first hole and the second hole configured to apply a compressive force on the seam via the first flange and the second flange.

2. The roofing anchor of claim 1, wherein each of the first segment and the second segment is made from a single material and formed as a single rigid part.

3. The roofing anchor of claim 2, wherein the hinge mechanism includes at least one first bore formed by the first segment, at least one second bore formed by the second segment, and a rod configured to the inserted into the at least one first bore and the at least one second bore.

4. The roofing anchor of claim 1, wherein the first segment and the second segment have an identical shape or have at least enough similarity to allow the first segment and the second segment to be formed by a single extrusion.

5. The roofing anchor of claim 1, wherein the elongated member includes a threaded section engageable by a nut to allow the first segment and the second segment to be separated and allow a compressive force to be exerted to close the roofing anchor.

6. The roofing anchor of claim 1, wherein the first hole and the second hole each have a diameter that is greater than a diameter of the elongated member and have a shape configured to allow the first segment and the second segment to be rotated relative to the hinge mechanism without removing the elongated member from the holes.

7. The roofing anchor of claim 1, wherein the roofing anchor is configured to be opened by separating the first flange from the second flange by an amount sufficient to dispose the roofing anchor on the roof seam without removing any parts from the roofing anchor.

8. The roofing anchor of claim 1, wherein the opposing segments and the flanges define a cavity having a width selected to be larger than a width of an upper portion of the seam.

9. The roofing anchor of claim 1, further comprising an anchor point attached to the roofing anchor configured to secure at least one of an object and a person to the roofing anchor to prevent the object or person from falling from roof panel.

10. The roofing anchor of claim 1, further comprising a platform attached to the roofing anchor configured to support at least one of an object and a person on the roofing anchor.

11. The roofing anchor of claim 1, further comprising a post extending generally vertical from the roofing anchor when the roofing anchor is attached to the roofing panel.

12. The roofing anchor of claim 11, wherein the post is pivotally attached to the roofing anchor to vertically adjust the rail.

13. The roofing anchor of claim 1 further comprising:

A second roofing anchor configured to be removably secured to the seam or to a second seam of the roof, the second roofing anchor including a pair of second opposing segments, the second roofing anchor secured to the seam or to the second seam by closing the second roofing anchor to bring the pair of second opposing segments in contact with the seam or the second seam and maintaining a compressive force on the seam or second seam via the pair of second opposing segments;

a first post extending generally vertical from the roofing anchor when the roofing anchor is attached to at least one of the roofing panels;

a second post extending generally vertical from the second roofing anchor when the second roofing anchor is attached to at least one of the roofing panels; and a component extending between the first and second posts to provide a guard rail.

14. A method of removably securing an object or person to a roof by a roofing anchor, comprising:

opening the roofing anchor, the roofing anchor including a first segment having a first flange, a second segment opposing the first segment, the second segment having a second flange opposite the first flange, and a hinge mechanism formed by respective features on the first segment and the second segment, wherein opening the roofing anchor includes separating the first flange and the second flange by a distance greater than at least a top of a seam of a roofing panel on the roof;

disposing the roofing anchor over the seam;

closing the roofing anchor via the hinge mechanism to bring the first flange into contact with a first side of the seam and to bring the second flange into contact with a second side of the seam; and securing the roofing anchor to the seam by engaging a securing mechanism to apply a compressive force on the seam via the first flange and the second flange;

wherein the engaging the securing mechanism includes inserting an elongated member through a first hole in the first segment and a second hole in the second segment, and engaging an end of the elongated member with a nut applying the compressive force.

15. The method of claim 14, wherein each of the first segment and the second segment is made from a single material and formed as a single rigid part.

16. The method of claim 14, wherein the first segment and the second segment have an identical shape or have at least enough similarity to allow the first segment and the second segment to be formed by a single extrusion.

17. The method of claim 14, wherein the hinge mechanism includes at least one first bore formed by the first segment, at least one second bore formed by the second segment, and a rod configured to the inserted into the at least one first bore and the at least one second bore.

18. The method of claim 14, wherein the first hole and the second hole each have a diameter that is greater than a diameter of the elongated member and have a shape configured to allow the first segment and the second segment to be rotated relative to the hinge mechanism without removing the elongated member from the holes.

19. The method of claim 14, wherein opening the roofing anchor includes separating the first flange from the second flange by an amount sufficient to dispose the roofing anchor on the roof seam without removing any parts from the roofing anchor.

20. An anchoring system for a standing seam roof, comprising:

a first roofing anchor configured to be removably secured to a first seam of at least one roofing panel, the first roofing anchor including a first pair of opposing segments, the first roofing anchor secured to the first seam by closing the first roofing anchor to bring the first pair of opposing segments in contact with the first seam and maintaining a compressive force on the first seam via the first pair of opposing segments;

a second roofing anchor configured to be removably secured to the first seam or to a second seam of the at least one roofing panel, the second roofing anchor including a second pair of opposing segments, the second roofing anchor secured to the second seam by closing the second roofing anchor to bring the second pair of opposing segments in contact with the second seam and maintaining a compressive force on the second seam via the second pair of opposing segments; and an attachment configured to be attached to the first roofing anchor and the second roofing anchor, the attachment including:

an elongated body having a first end and a second end;

a first bracket configured to be connected to the first end to attach the elongated body to the first roofing anchor, the first bracket having a first pivot structure configured to permit rotation of the elongated body about a first pivot point proximate to the first end; and a second bracket configured to be connected to the second end to attach the elongated body to the second roofing anchor, the second bracket having a second pivot structure configured to permit rotation of the elongated body about a second pivot point proximate to the second end.

21. The anchoring system of claim 20, wherein the anchoring system is configured to be adjusted to change a distance between the first roofing anchor and the second roofing anchor by performing at least one of: rotating the first end of the elongated body about the first pivot structure, and rotating the second end of the elongated body about the second pivot structure.

22. The anchoring system of claim 20, further comprising a component attached to the elongated body, the component configured to be connected to at least one of a person and an object to prevent the at least one of the person and the object from falling off the roof.

23. The anchoring system of claim 20, wherein each of the first and second roofing anchors is configured to be opened by separating each respective first and second flanges by an amount sufficient to dispose the first and second roofing anchors on the respective roof seam without removing any parts from the first and second roofing anchors.

* * * * *